US010875203B2

(12) United States Patent
Kaposi et al.

(10) Patent No.: US 10,875,203 B2
(45) Date of Patent: Dec. 29, 2020

(54) ONION CHOPPER

(71) Applicant: Progressive International Corporation, Kent, WA (US)

(72) Inventors: Sascha Kaposi, Tacoma, WA (US); Kyle Aasness, Athens, GA (US)

(73) Assignee: Progressive International Corp., Kent, WA (US)

( * ) Notice: Subject to any disclaimer, the term of this patent is extended or adjusted under 35 U.S.C. 154(b) by 23 days.

(21) Appl. No.: 16/283,494

(22) Filed: Feb. 22, 2019

(65) Prior Publication Data

US 2019/0263012 A1 Aug. 29, 2019

Related U.S. Application Data

(60) Provisional application No. 62/636,599, filed on Feb. 28, 2018.

(51) Int. Cl.

| | |
|---|---|
| ***B26D 3/18*** | (2006.01) |
| ***B26D 3/26*** | (2006.01) |
| *B26D 3/28* | (2006.01) |

(52) U.S. Cl.

CPC ..... *B26D 3/26* (2013.01); *B26D 3/185* (2013.01); *B26D 2003/288* (2013.01)

(58) Field of Classification Search

CPC .... B26D 3/185; B26D 2003/288; A47J 43/25; A47J 43/26

USPC ..... 83/856–858

See application file for complete search history.

(56) References Cited

U.S. PATENT DOCUMENTS

| | | | | |
|---|---|---|---|---|
| 2,500,560 | A * | 3/1950 | Morris | A47J 43/25 241/95 |
| 2,714,908 | A * | 8/1955 | Carmack | A47J 43/25 241/95 |
| 2,720,234 | A | 10/1955 | Fett | |
| D307,532 | S | 5/1990 | Cautereels et al. | |
| 5,303,472 | A | 4/1994 | Mbanugo | |
| 5,692,424 | A | 12/1997 | Wallace | |
| 5,704,485 | A | 1/1998 | Cautereels et al. | |
| D447,019 | S | 8/2001 | Wong | |
| 6,805,032 | B2 | 10/2004 | Engdahl | |
| D499,615 | S | 12/2004 | Nordgren | |
| 7,191,691 | B2 | 3/2007 | Kaposi | |
| D546,638 | S | 7/2007 | Kaposi | |
| D548,022 | S | 8/2007 | Kaposi | |
| D548,025 | S | 8/2007 | Kaposi | |
| 7,762,169 | B2 | 7/2010 | Kaposi | |
| 7,992,476 | B2 | 8/2011 | Kaposi | |
| 9,370,278 | B1 | 6/2016 | Suquet et al. | |
| 2005/0252387 | A1* | 11/2005 | Cornfield | B26D 3/185 99/500 |

(Continued)

FOREIGN PATENT DOCUMENTS

DE 202009006804 U1 9/2009

*Primary Examiner* — Andrea L Wellington
*Assistant Examiner* — Liang Dong
(74) *Attorney, Agent, or Firm* — Lowe Graham Jones, PLLC

(57) ABSTRACT

An onion chopper includes container, a blade tray, and pivoting lid. The blade tray is removably mounted on an upper rim of the container and includes a sweeper positioned at one end of the blade tray. The sweeper is dimensioned to fit within the sidewalls forming the container to be used to clear chopped food bits from the container after they are cut by the grid of blades.

18 Claims, 5 Drawing Sheets

(56) References Cited

U.S. PATENT DOCUMENTS

| | | | | |
|---|---|---|---|---|
| 2006/0090352 | A1 | 5/2006 | Kaposi | |
| 2006/0218799 | A1* | 10/2006 | Kaposi | B26D 3/185 30/302 |
| 2012/0231717 | A1* | 9/2012 | Zean | B26D 5/10 452/144 |
| 2014/0061343 | A1* | 3/2014 | Waibel | A47J 43/25 241/95 |
| 2014/0109743 | A1 | 4/2014 | Wong | |
| 2015/0217460 | A1 | 8/2015 | Hauser et al. | |
| 2016/0075043 | A1 | 3/2016 | Cotter | |
| 2018/0154536 | A1* | 6/2018 | Repac | B26B 27/00 |

* cited by examiner

ONION CHOPPER

PRIORITY CLAIM

This application claims the benefit of U.S. provisional application No. 62/636,599 filed Feb. 28, 2018, the contents of which are incorporated by reference.

BACKGROUND OF THE INVENTION

In preparing food, it is often desirable to prepare onions by slicing them in strips or chopping them into small pieces. Most commonly, this is done by using a knife. There are other specially-designed devices for chopping foods, such as shown in U.S. Pat. No. 7,191,691, which describes a container having a blade tray and a pivoting lid with a grid of projections to force the onion through the grid of blades for chopping.

Though such devices work quite well, the narrow nature of the container can make it difficult to remove all the chopped onions or other food items from the container after they are cut by the grid of blades.

SUMMARY OF THE INVENTION

An onion chopper includes a container, a blade tray having a sweeper, and a pivoting lid.

In some versions, the container has a bottom with a forward end wall, a rearward end wall, and a pair of opposing sidewalls each extending upwardly from the bottom and terminating in a rim, the pair of opposing sidewalls having a first width between the pair of opposing sidewalls.

The blade tray is removably supported by the rim and includes a plurality of blades. The sweeper is preferably incorporated into the blade tray and has a second width which is less than or equal to the first width, whereby the sweeper can be inserted into the container and span between the pair of opposing sidewalls.

The lid is pivotally attached to the device for movement between a closed position adjacent the blade tray and an open position pivoted away from the tray, the lid having a plurality of projections sized and configured to be received between the plurality of blades when the lid is in the closed position.

The blade tray may include a first end and a second end, the second end being configured to be positioned toward the rearward end wall when the blade tray is supported by the rim, and further wherein the sweeper is formed in the second end of the blade tray.

The plurality of blades, in some versions, are provided at an intermediate location along the blade tray between the first end and the second end.

The blade tray further may comprise a handle at the first end of the blade tray.

In some versions, an opening is provided between the forward end wall and the first end of the blade tray when the blade tray is supported by the rim.

The rim may further comprise a recessed portion, the blade tray being supported by the recessed portion of the rim.

The rim and the blade tray may further have complementary interlocking features.

The forward end wall of the container preferably includes a planar portion, and may be inclined with respect to the bottom at an angle of greater than 90 degrees.

The container has a height from the bottom to the rim, and the sweeper has a length, the length being greater than or equal to the height in some versions.

The sweeper may be attached to the blade tray, or be integrally formed with the blade tray, the sweeper having a second width which is less than or approximately equal to the first width.

In some versions, at least a portion of the sweeper is positioned below the rim when the blade tray is attached to the rim of the container.

DETAILED DESCRIPTION OF THE PREFERRED EMBODIMENT

Figure 1:
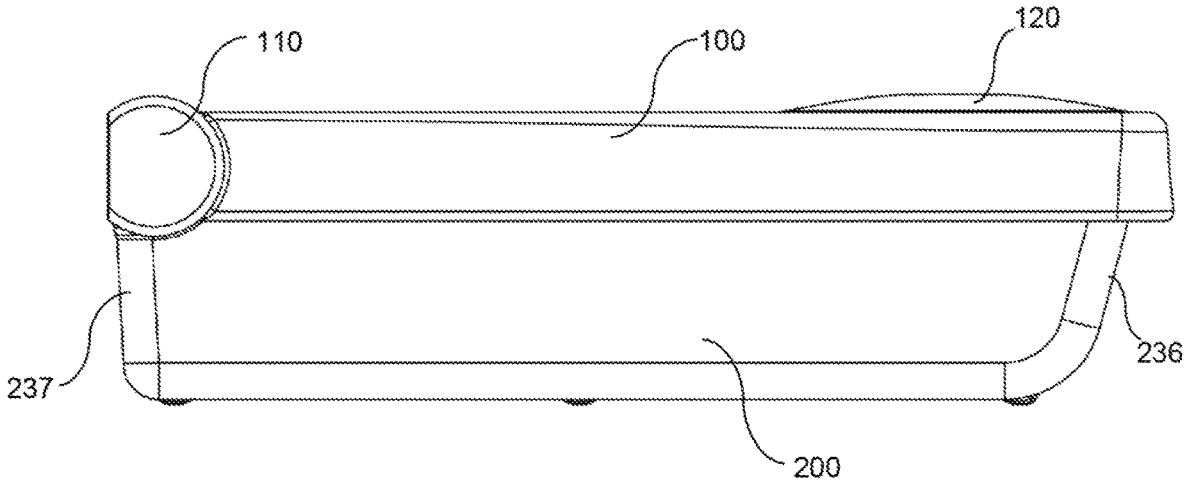
FIG. 1 is a side elevational view of a preferred onion chopper.

One example of a preferred food chopper is shown in FIG. 1. In many instances the device may be called an "onion chopper," but it should be appreciated that even under this name the device is also suitable for chopping other food items such as carrots, apples, and the like. In the embodiment of FIG. 1, the food chopper includes a lid 100 pivotally attached to a lower container 200 at a pivot location 110 positioned at a rearward end 237 of the food chopper container, which has an opposite forward end 236. At the forward end of the food chopper, the lid may optionally have a raised grip area 120 to accommodate the hand of a user in pushing the forward end of the lid downwardly against the container.

Figure 3:
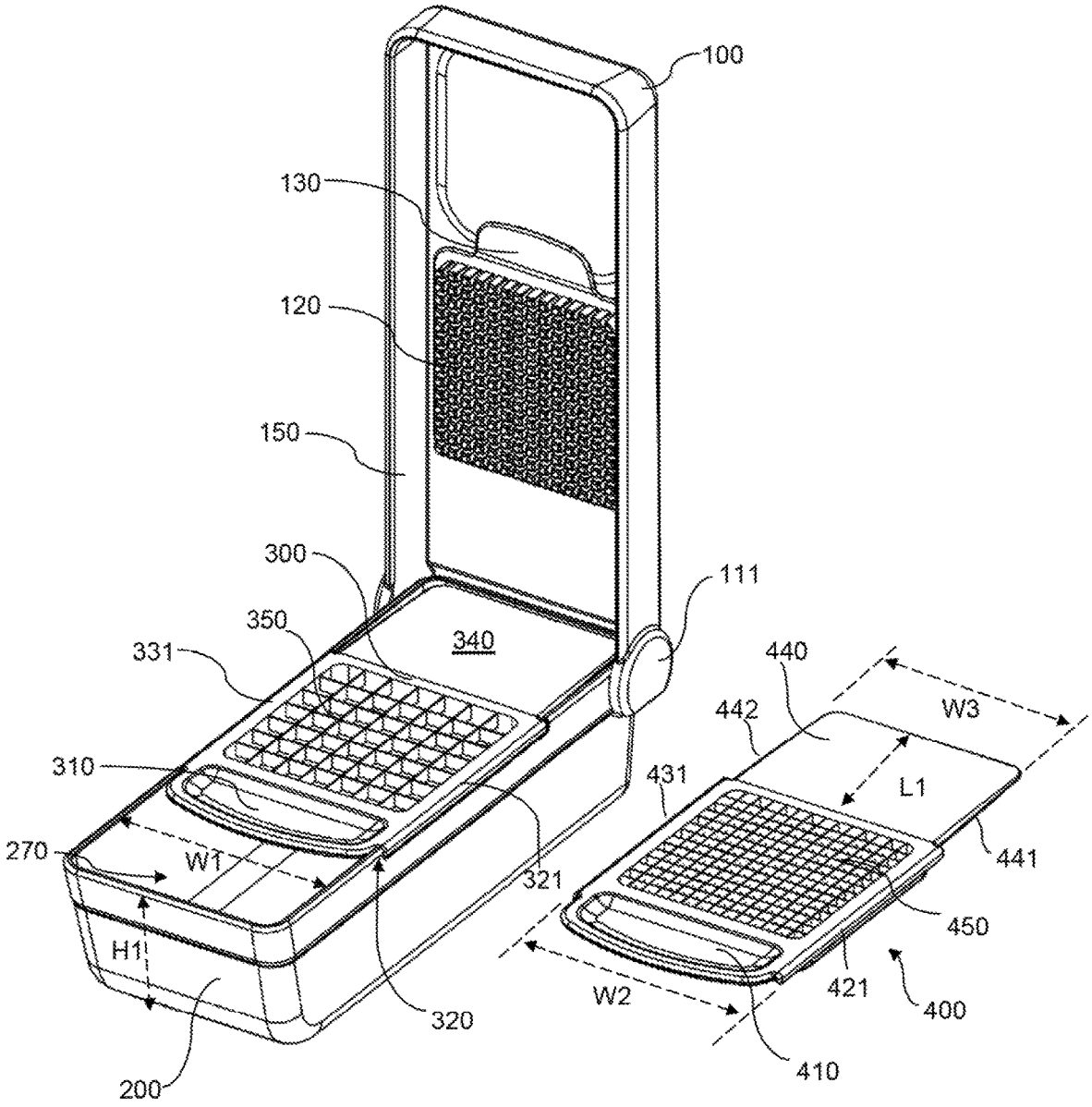
FIG. 3 is a perspective view of a preferred onion chopper, shown alongside an optional additional blade tray.
Figure 4:
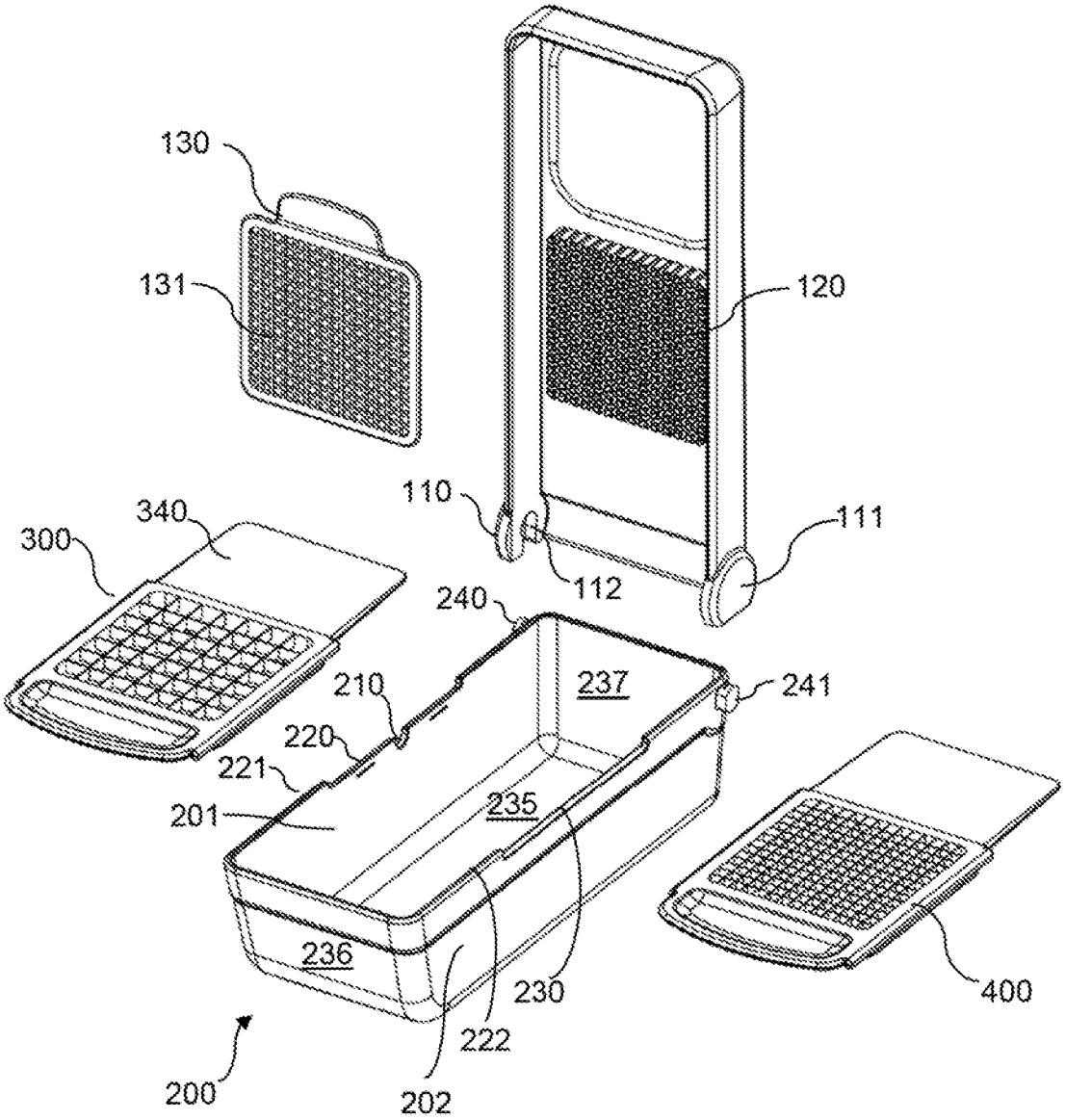
FIG. 4 is an exploded perspective view of a preferred onion chopper.

The lid is generally rectangular in shape (that is, in the shape of the perimeter when viewed from the top), such as best seen in FIGS. 3 and 4, having squared corners at the rearward pivot end and slightly rounded corners at the opposite forward end. The squared or rectangular nature of the container, and preferred substantially planar walls, facilitates cleaning them with the sweeper as described further below. A downward-extending flange 150 (see FIG. 3) surrounds the peripheral edge of the lid, and is sized and shaped to snugly receive an outer surface of the container within the flange when the lid is rotated downward against the reservoir in the position illustrated in FIG. 1.

The lid further includes a grid of projections 120 on the inner surface, extending downward in the same direction as that of the flange. The projections may take on any size or shape, as desired, and are ideally shaped to thoroughly push the food through the blades within the blade tray. The blade tray 300, 400 includes a network of blades 350, 450, preferably configured at right angles and forming generally square openings, although in some versions the blades may be parallel and not perpendicular. The projections on the lid are sized and located within the lid such that when the lid is closed one or more projections fits within each of the blade openings. In other versions, the blades may be configured differently, preferably with the grid of projections likewise being configured in a complementary fashion.

The food reservoir or container 200 is formed in substantially the same shape as the lid when viewed from the top, again best seen in FIGS. 3 and 4. Thus, in the preferred form, it has a generally rectangular shape with two rounded corners, so that an upper rim of the container fits snugly within the flange 150 of the lid. The reservoir includes a bottom 235 and four side walls to form an interior (approximately) rectangular cubic cavity. The depth of the reservoir may vary, and is preferably sized to hold a typical expected volume of onions, mushrooms, or other food ingredients that may be used in cooking. In this regard, the device may be considered an onion chopper because it is especially suited for chopping onions, but it should be appreciated that it is capable of chopping other food items as well, despite being referred to as an onion chopper. The opposing sidewalls 201, 202 are preferably elongated with respect to the forward end wall 236 and rearward end wall 237 which are preferably narrower.

Figure 2:
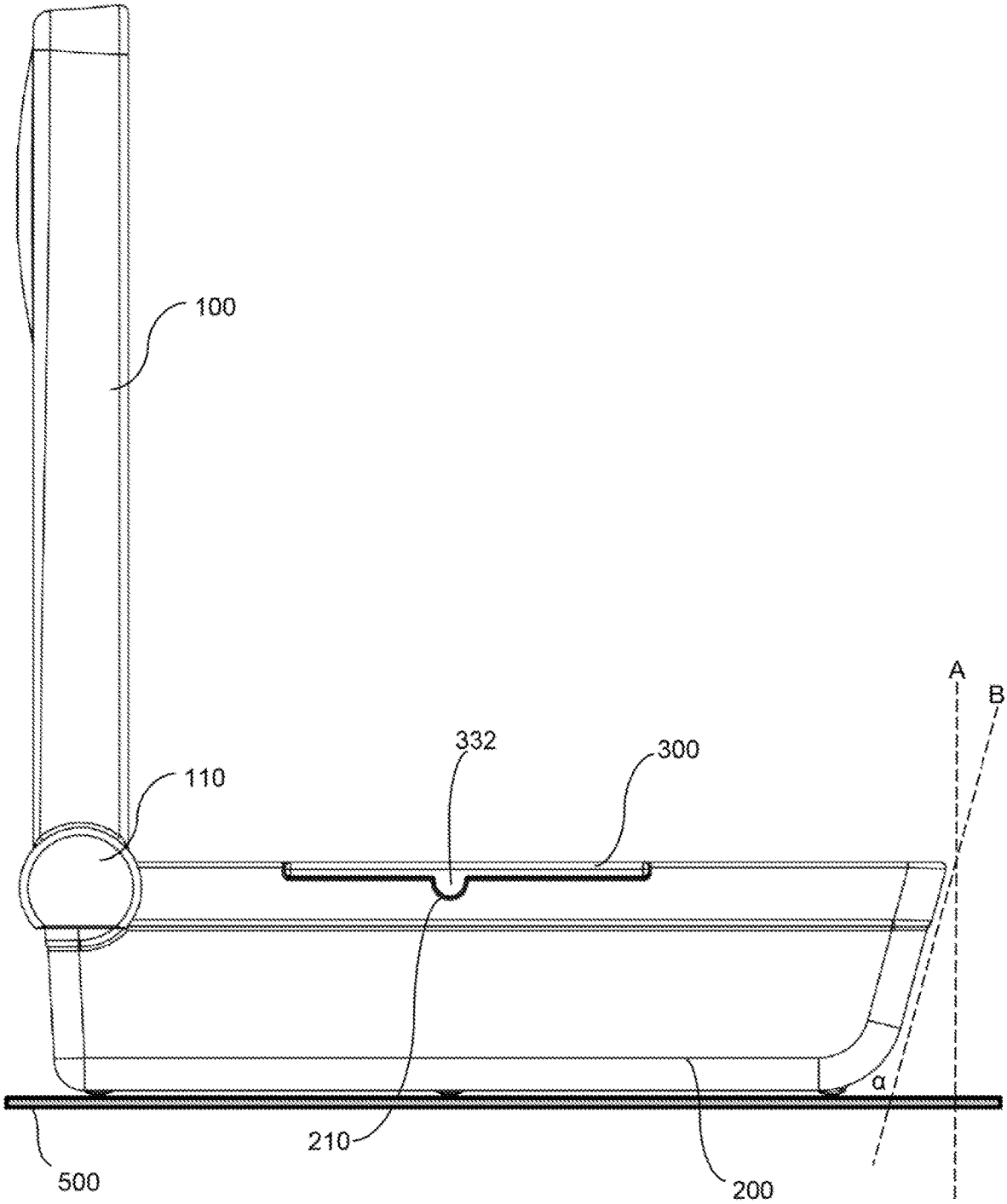
FIG. 2 is a side elevational view of the preferred onion chopper of FIG. 1, shown with the lid rotated to an open position.

The reservoir includes a boss 240, 241 at opposing sides of the rearward ends of the top of the container. The bosses are configured to be received within a pair of cavities (e.g., cavity 112 formed in pivot mount 110; the opposing inward-facing cavity is formed in pivot mount 111 and not visible) at opposite sides of the rear end of the lid, forming the pivotal connection between the lid and the container. Accordingly, the lid is able to rotate about the pivotal connection from an open position such as shown in FIG. 2 that is preferably at least about 90 degrees with respect to the blade tray, to a closed position such as shown in FIG. 1 in which the lid is resting adjacent and substantially flush with the blade tray.

In alternate embodiments of the invention, the reservoir also includes volumetric measurements on an inner or outer surface. The measurements enable the user to determine the volume of chopped food items without the necessity of a further step of transferring the ingredient to an additional measuring cup.

The preferred blade tray is configured to rest at an upper end of the container, and most preferably atop the rim of the container. In the illustrated example, two blade trays 300, 400 are provided in which each blade tray is formed with the same perimeter and overall shape, differing in the number of blades and therefore the size of the openings between blades. Thus, two separate blade trays 300, 400 are illustrated in the exploded view of FIG. 4. In FIG. 3, a first blade tray 300 is shown in position on the container while a second blade tray 400 is shown separate from the container.

The blade tray 300 is formed to allow it to rest atop the upper rim of the container. Most preferably, as best seen in FIG. 4, the container includes opposing sidewalls 201, 202 which each extend upwardly from the floor 235 and terminate in a first sidewall rim 221 and a second sidewall rim 222. A portion of each of the first and second sidewall rims, preferably located centrally or at the middle between the forward end 236 and the rearward end 237 is recessed and therefore somewhat shorter than the rest of the surrounding sidewall rim. As seen in FIG. 4, the first sidewall 201 includes a first sidewall rim 221 with a first central recessed region 220. Similarly, the opposing second sidewall 202 includes a second sidewall rim 222 having a second central recessed region 230. One, the other, or both of the recessed areas may have additional interlocking features. For example, the first sidewall rim includes a scallop 210 as a small cutout within the first central recessed region 220.

The blade trays are configured to be supported by the container, and the rim, in the regions as described above. As best seen in FIG. 3, the first blade tray 300 is positioned atop the container and supported by the first and second sidewall rims. The first blade tray includes a first side 331 supported by the first central recessed region and an opposing second side 321 supported by the second central recessed region. Most preferably, each of the first and second sides includes a concavity or channel, e.g. channel 320 having a length that is the same as or perhaps less than the length of the corresponding central recessed region. The channel as illustrated is a raised channel with a closed top and an open bottom portion, being convex when viewed from the top and concave when viewed from the bottom. Accordingly, a portion of the rim (and preferably in the central recessed region) fits with the channel when the blade tray is in position atop the container.

A forward end of the blade tray is preferably configured with a grip 310 or handle, extending forwardly from the grid of blades 350 to allow a user to grasp the blade tray. In the illustrated example, the handle is configured as a concavity at the forward end of the bladed tray. A rearward end of the blade tray is configured with a sweeper 340, which in the preferred example is a substantially planar surface.

The second blade tray 400 is configured in the same fashion, having a grip 410 and a sweeper 440, with the opposing first side 431 and second side 421 of the blade tray being formed with channels as described above, and also having an interior blade tray 450.

In one version, the blade tray and rim have complementary interlocking features. For example, the blade trays may be configured with a projection (e.g. downward projection 332; see FIG. 2) on one side, which is sized and configured to be received within the corresponding scallop 210 (or cutout having a shape that may not be rounded, as with a scallop) in the central recessed region. In other versions the cutout and projection may be reversed, and may be included on both sides of the container and tray.

As best seen with reference to the second blade tray 400, but in the preferred embodiment applying equally to the first blade tray 300, the blade tray has a blade tray width W2 extending from the first side 431 to the second side 421. The blade tray sweeper 440 has a sweeper width W3 extending across from one side 441 to the other side 442 of the sweeper, and in the preferred example the sweeper width W3 is narrower than the blade tray width W2. The interior of the container has a container width W1 extending between the opposing sidewalls. In the preferred version, the width of the sweeper W3 is the same as or slightly less than (in other words, less than or equal to) the width W1 of the container. Depending on the nature of the container and the materials, it may be possible to make the sweeper width fractionally larger than the sidewall width, but in which the sweeper compresses and/or the sidewalls bow outwardly when in use sweeping the container. In this case, the two lengths are "approximately equal" but fractionally different.

The sweeper further has a length L1 from the boundary of the frame surrounding the grid of blades to the rearward end of the sweeper, which is preferably greater than or equal to a height H1 of the container from the floor to the opposing sidewall rims, or the opposing recessed central regions.

Preferably, the tray is formed from plastic and the blade grid formed from stainless steel. The top edges of the blades within the grid are sharpened in order to slice through the foods that are being pushed through the blade grid from above.

In the illustrated example, the blade trays extend from the rearward end of the container toward the front end of the container but stopping short of the front end of the container. Most preferably this provides an interior volume in an open area 270 between the forward end wall of the container and the blade tray when the blade tray is in position atop the container, so that bits of food cut by the device can fall through the open area if they are pushed forward and do not pass through the grid of blades. In addition, it allows a user to readily grasp the entire handle portion of the blade tray by inserting a hand into the open area 270. Thus, most preferably the open area is sized to accommodate a hand of a user and it is at least one inch or more preferably at least two inches between a forwardmost rim of the container at the forward end wall and the forwardmost portion of the blade tray or blade tray handle.

The container may optionally include non-skid feet attached to the bottom, formed from silicone or other suitable materials. In yet other embodiments, the container may include a removable bottom section that is preferably friction-fitted or snap-fitted into the container Thus, with the bottom section in place, food that is chopped with the device will be retained within the reservoir and can be readily carried to a pot or bowl. With the bottom removed, the chopper can be placed directly onto a plate, bowl, or other device to allow food to be chopped and dropped directly into the plate, bowl, or pan.

A cleaning grid 130 may optionally be provided, having a grid of openings sized to receive the projections from the grid of projections 120 on the interior surface of the lid, so that the removal of the cleaning grid will also remove any bits of food stuck between the grid of projections.

As best seen in FIG. 2, the container is configured to be used when resting atop a horizontal surface 500 such as a countertop. In this open position, an onion or other food item can be placed atop the grid of blades for chopping, and the lid 100 rotated downward (clockwise in FIG. 2, from the open position toward the closed position) to chop the food item. The forward end wall of the container is inclined with respect to the vertical axis A, shown in FIG. 2 as being perpendicular to the horizontal countertop surface. Thus, in one version the forward end wall is inclined to define an angle $\alpha$ which is greater than 90 degrees with respect to the horizontal plane. In one version the forward end wall is inclined at least 10 degrees thereby forming an angle of at least 100 degrees with respect to the floor of the container. In another version, it is inclined in the range of 10 degrees and 20 degrees, or between 15 degrees and 25 degrees. In addition, the forward end of the container is preferably flat or planar (other than the inclusion of rounded corners), and has a shape that mates with the rearward end of the sweeper (which may have accommodating rounded corners) so that the sweeper can sweep across the bottom and the interior forward end wall of the container to brush food thoroughly from the container.

Figure 5:
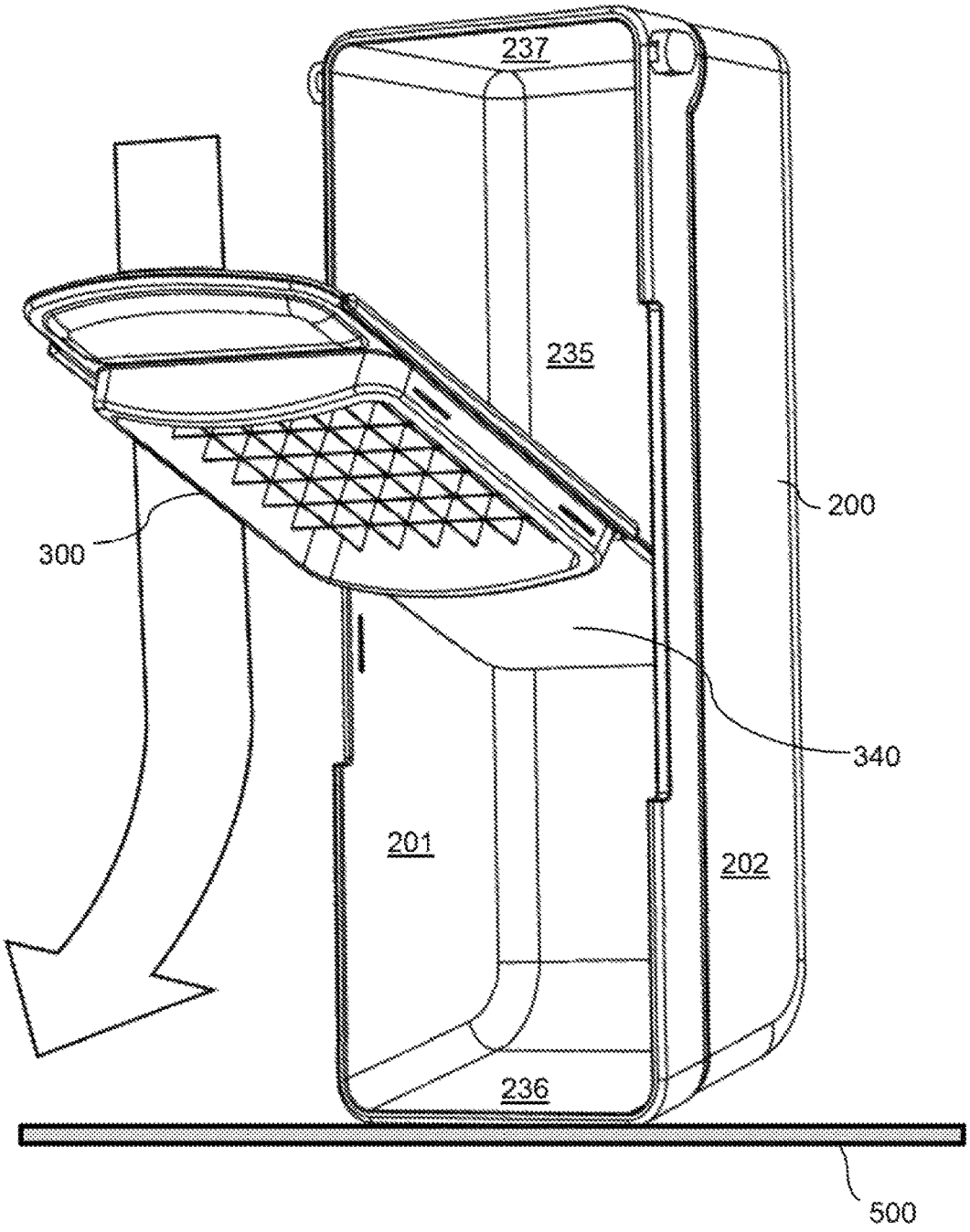
FIG. 5 is a partial exploded view of a preferred onion chopper, shown with the lid removed and the sweeper inserted into the container which has been tipped on one end.

When the reservoir is full, or the chopping is completed, the tray is removed from the top of the reservoir, preferably by grasping the handle or forwardmost end of the tray. Preferably, the lid is also removed. The tray can be tipped on end, with the forward end wall of the container resting against a countertop 500 rather than the bottom resting against the countertop, as seen in FIG. 5. The inclined forward end wall allows the container to be tipped onto a cutting board or plate when chopping is finished, so that the container is supported on a horizontal surface by the forward end wall but is not vertical. This position is best seen in FIG. 5. The sweeper portion 440 of a blade tray 300 can be inserted into the container, as seen in FIG. 5, to sweep the food items from the container by moving it in the direction of the arrow in FIG. 5. Because the sweeper is configured with a width which is less than or equal to the width of the container, the sweeper can effectively remove everything from the container in one pass. In the illustrated example, the sweeper further has rounded corners that mate with complementary rounded corners at the bottom of the container.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

We claim:

1. An onion chopper, comprising:

a container having a bottom with a forward end wall, a rearward end wall, and a pair of opposing sidewalls each extending upwardly from the bottom and terminating in a rim, the pair of opposing sidewalls having a first width between the pair of opposing sidewalls, the sidewalls being elongated with respect to the forward end wall and the rearward end wall;

a blade tray removably supported by the rim, the blade tray having a plurality of blades, the blade tray including a sweeper, the sweeper having a second width extending from a first side of the sweeper to a second side of the sweeper, the second width being less than or equal to the first width, the sweeper further having a sweeper length extending to a rearward end of the sweeper, whereby the sweeper can be inserted into the container and in which, when inserted, the second width spans between the pair of opposing sidewalls and the rearward end of the sweeper extends to the bottom of the container;

the container further having a height from the bottom to the rim, wherein the sweeper length is greater than or equal to the height; and a lid pivotally attached to the device for movement between a closed position adjacent the blade tray and an open position pivoted away from the tray, the lid having a plurality of projections sized and configured to be received between the plurality of blades when the lid is in the closed position, the sweeper further being positioned in an interior space between the container and the lid when the blade tray is supported by the rim and when the lid is in the closed position.

2. The onion chopper of claim 1, wherein the blade tray includes a first end and a second end, the second end being configured to be positioned toward the rearward end wall when the blade tray is supported by the rim, and further wherein the sweeper is formed in the second end of the blade tray.

3. The onion chopper of claim 2, wherein the plurality of blades are provided at an intermediate location along the blade tray between the first end and the second end.

4. The onion chopper of claim 3, wherein an open area is provided between the forward end wall and the first end of the blade tray when the blade tray is supported by the rim.

5. The onion chopper of claim 1, wherein the forward end wall of the container includes a planar portion.

6. The onion chopper of claim 5, wherein the forward end wall of the container is inclined with respect to the bottom at an angle of greater than 90 degrees.

7. An onion chopper, comprising:

a container having a bottom with a plurality of walls extending upwardly from the bottom and terminating in a rim to define an interior volume, the rim extending to a first height above the bottom;

the plurality of walls including a forward end wall, a rearward end wall, and a pair of opposing sidewalls between the first end wall and the rearward end wall, the opposing sidewalls being separated by a first width;

a blade tray removably supported by the rim, the blade tray having a plurality of blades formed in a grid;

a sweeper attached to the blade tray, the sweeper having a first side and an opposing second side defining a second width which is less than or approximately equal to the first width, wherein the sweeper is insertable into the container between the pair of opposing sidewalls and to the bottom of the container;

the container further having a height from the bottom to the rim, wherein the sweeper length is greater than or equal to the height; and a lid pivotally attached to the device for movement between a closed position adjacent the blade tray and an open position pivoted away from the tray, the lid having a plurality of projections sized and configured to be received between the plurality of blades when the lid is in the closed position, the sweeper further being positioned in an interior space between the container and the lid when the blade tray is supported by the rim and when the lid is in the closed position.

8. The onion chopper of claim 7, wherein the blade tray includes a first end and a second end, the sweeper being formed in the second end of the blade tray.

9. The onion chopper of claim 8, wherein the plurality of blades are positioned at an intermediate location along the blade tray between the first end and the second end.

10. The onion chopper of claim 9, wherein the blade tray further comprises a handle at the first end of the blade tray.

11. The onion chopper of claim 7, wherein the rim further comprises a recessed portion, the blade tray being supported by the recessed portion of the rim.

12. The onion chopper of claim 7, wherein at least a portion of the sweeper is positioned below the rim when the blade tray is attached to the rim of the container.

13. The onion chopper of claim 7, wherein the rim and the blade tray comprise complementary interlocking features.

14. The onion chopper of claim 7, wherein the forward end wall of the container includes a planar portion.

15. The onion chopper of claim 14, wherein the forward end wall of the container is inclined upwardly and outwardly with respect to the bottom.

16. An onion chopper, comprising:

a container having a bottom with a plurality of walls extending upwardly from the bottom and terminating in a rim to define an interior volume, the rim extending to a first height above the bottom;

the plurality of walls including a forward end wall, a rearward end wall, and a pair of opposing sidewalls between the first end wall and the rearward end wall, the opposing sidewalls being separated by a first width;

a blade tray removably supported by the rim, the blade tray having a first end and a second end, and a first side and an opposing second side, the blade tray further having a plurality of blades formed in a grid;

the second end of the blade tray having a second width extending between the first side and the opposing second side whereby the second end of the blade tray forms a sweeper, the second width being less than or approximately equal to the first width, the container further having a height from the bottom to the rim, wherein the sweeper length is greater than or equal to the height, wherein the sweeper is insertable into the container between the pair of opposing sidewalls and to the bottom of the container; and a lid pivotally attached to the device for movement between a closed position adjacent the blade tray and an open position pivoted away from the tray, the lid having a plurality of projections sized and configured to be received between the plurality of blades when the lid is in the closed position, the sweeper further being positioned in an interior space between the container and the lid when the blade tray is supported by the rim and when the lid is in the closed position.

17. The onion chopper of claim 16, wherein the lid is pivotally attached to the container at a pivot location, the sweeper being positioned adjacent the pivot location when the blade tray is supported by the rim.

18. The onion chopper of claim 16, wherein the plurality of blades are positioned at an intermediate location along the blade tray between the first end and the second end.

* * * * *